US006422252B1

(12) United States Patent
Pilz et al.

(10) Patent No.: US 6,422,252 B1
(45) Date of Patent: Jul. 23, 2002

(54) COLLAPSIBLE SUN PROTECTION DEVICE

(75) Inventors: Helmut Pilz, Gruenkraut; Franz Kordeuter, Ravensburg, both of (DE)

(73) Assignee: Holly Produkte Vertriebs-und Lizenz GmbH, Gruenkraut (DE)

( * ) Notice: Subject to any disclaimer, the term of this patent is extended or adjusted under 35 U.S.C. 154(b) by 0 days.

(21) Appl. No.: 09/521,944

(22) Filed: Mar. 9, 2000

(30) Foreign Application Priority Data

Nov. 17, 1999 (DE) ..... 299 20 235 U

(51) Int. Cl.[7] ..... A45B 19/00; A45B 17/00; E04H 15/28

(52) U.S. Cl. ..... 135/98; 135/20.1; 135/99; D3/2; D3/5

(58) Field of Search ..... 135/20.1, 98, 99; D3/2, 5

(56) References Cited

U.S. PATENT DOCUMENTS

| | | | | | |
|---|---|---|---|---|---|
| 1,409,609 | A | * | 3/1922 | Stockle | 135/99 X |
| 1,526,726 | A | * | 2/1925 | Townsend | 135/99 |
| 4,086,931 | A | * | 5/1978 | Hall | 135/99 X |
| 4,433,699 | A | * | 2/1984 | Schultes et al. | 135/98 X |
| 4,836,231 | A | | 6/1989 | Peterson | 135/98 |
| 4,836,232 | A | | 6/1989 | De Rosa et al. | 135/99 |
| D359,161 | S | * | 6/1995 | Byrne | D3/5 |
| D363,597 | S | * | 10/1995 | Byrne | D3/5 |
| 5,871,024 | A | * | 2/1999 | Vanderminden | 135/98 |
| D414,878 | S | * | 10/1999 | Byrne | D25/58 |
| D443,409 | S | * | 6/2001 | Pilz et al. | D3/5 |

FOREIGN PATENT DOCUMENTS

| | | | | |
|---|---|---|---|---|
| DE | 934546 | * | 10/1955 | 135/99 |
| DE | 1107904 | * | 10/1955 | 135/98 |
| DE | 1 786 900 | | 12/1958 | |
| DE | 1 276 874 | | 9/1968 | |
| DE | 296 14370 | | 11/1996 | |

* cited by examiner

*Primary Examiner*—Robert Canfield
(74) *Attorney, Agent, or Firm*—Morgan, Lewis & Bockius LLP

(57) ABSTRACT

A sun protection device is proposed having a fanlike sunshade which includes rods which are mounted at one end in a manner which allows them to pivot about a first common axis for individual adjustment, so that the rods can be collapsed and spread apart by pivoting about this first axis, and which has a sunshade covering which is mounted between the rods, and the device also having a sunshade pole on which the rods are arranged via a pivot joint which has a pivot axis extending transversely to the longitudinal axis of the sunshade pole. According to the invention, the pivot joint is designed in such a manner that in every position of the joint, the first pivot axis (11) lies in a plane with the longitudinal axis of the sunshade pole.

9 Claims, 4 Drawing Sheets

COLLAPSIBLE SUN PROTECTION DEVICE

Figure 1:
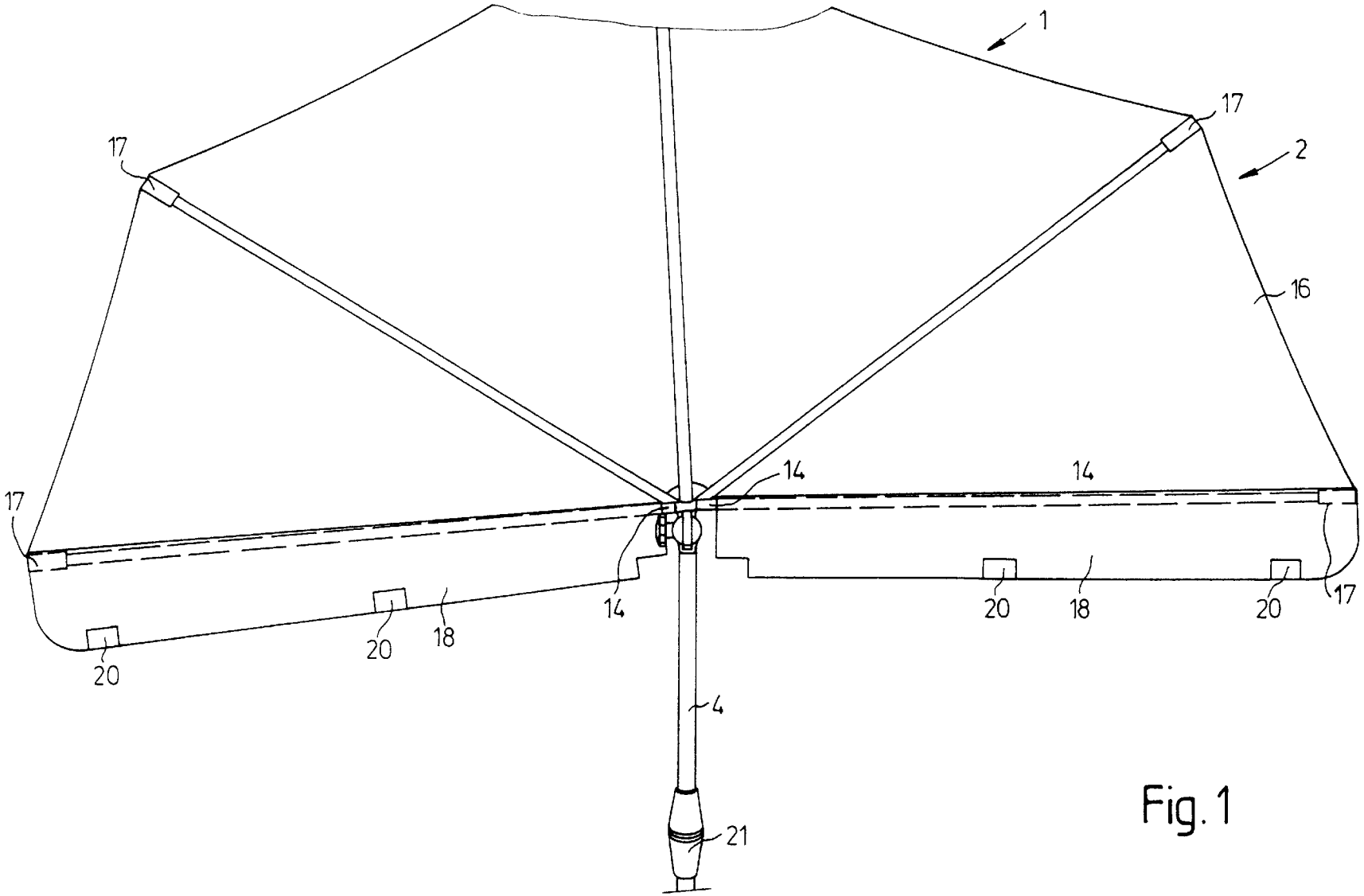

The invention relates to a sun protection device having a fanlike sunshade which includes rods which are mounted at one end in a manner which allows them to pivot about a common first axis for individual adjustment, so that the rods can be collapsed or spread apart by pivoting about this first axis, and which has a sunshade covering which is mounted between the rods, and the device also having a sunshade pole on which the rods are arranged via a pivot joint which has a pivot axis extending transversely to the longitudinal axis of the sunshade pole.

A sun protection device of this type is disclosed in German utility model DE 296 14 370.

The object of the invention is to provide a sun protection device of the type described in the introduction which, in particular when opened up, is comparatively more highly stable and can be collapsed comparatively more compactly.

This object is achieved, starting from a sun protection device of the type described in the introduction, by the pivot joint being designed in such a manner that in every position of the joint the first pivot axis lies in a plane with the longitudinal axis of the sunshade pole. This procedure means that the sunshade together with the rods is arranged symmetrically with regard to the sunshade pole, so that twisting forces about the longitudinal axis of the sunshade pole, for example because of a windforce acting uniformly on the sunshade, can be compensated for. The sun protection device can therefore more easily be positioned in a stable manner. This advantage also becomes noticeable if the sun protection device is used by way of assistance as a driving sail in a canoe, for example. Owing to the arrangement according to the invention of the axes, the sunshade together with a sunshade pole can also be collapsed particularly advantageously, since when folded up it can be positioned "symmetrically" against the sunshade pole.

In a preferred refinement of the invention the pivot joint is designed as an extension of the sunshade pole.

In order to obtain a comparatively simple construction of the pivot joint, it is furthermore proposed that the pivot joint has at least two pairs of joint surfaces which are arranged symmetrically to a plane in which the longitudinal axis of the sunshade pole lies.

In order to achieve a compact and stable construction of the pivot joint, it is moreover proposed that the pivot joint is spherical. As a result, circular ring-shaped pairs of joint surfaces can be achieved.

In a preferred embodiment, the pairs of joint surfaces have latching means, for example a toothing. Since, in contrast to the prior art, two pairs of joint surfaces are used, the pivot joint can be fixed in a position with comparatively little expenditure of force, for example via a locking screw.

This applies in particular if, in a further preferred embodiment, one joint piece of the pivot joint is of forked design and the limbs of the fork are resiliently flexible. The rods are preferably arranged in a manner which allows them to be folded up on a joint piece which is mounted rotatably between the limbs of the forked joint piece.

In a preferred refinement of the invention over and beyond that, the pivot joint is designed in such a manner that the first pivot axis is approximately aligned with the axis of the sunshade pole if the rods, as viewed from the side, are at a right angle to the sunshade pole. This measure enables the weight of the pivot joint to be positioned essentially above the longitudinal axis of the sunshade pole, as a result of which greater positional stability can be obtained at comparatively small forces of the locking screw on the pivot joint.

The first axis is preferably designed as a clamping screw, the sunshade covering being fixed on the clamping screw. The first affect of this measure is that even when the sunshade is folded up, the sunshade covering does not slip from the rods if the latter, in the front region of the rods, sits in correspondingly configured plug-in shoes, for example. Secondly, when the rods are spread apart, the sunshade covering can stretch out tautly.

In order to collapse the sun protection device in a particularly compact manner and in order to prevent the sunshade from unintentionally opening again from the collapsed state, it is moreover proposed that the sunshade covering extends beyond the outer rods and fastening means, for example a touch-and-close fastening or press-studs, are arranged in this preferably strip-shaped region.

DRAWINGS

Figure 2:
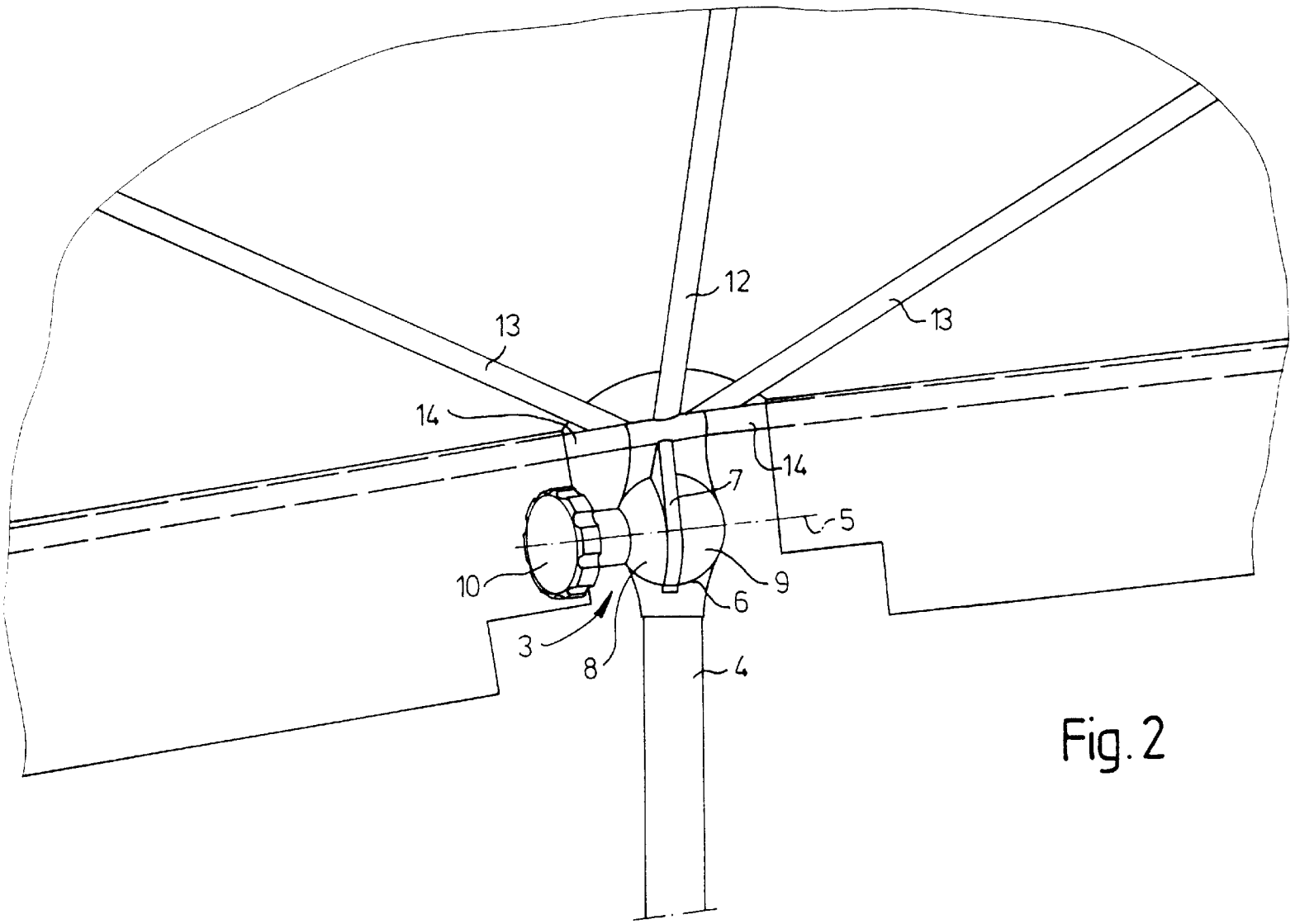
Figure 3A:
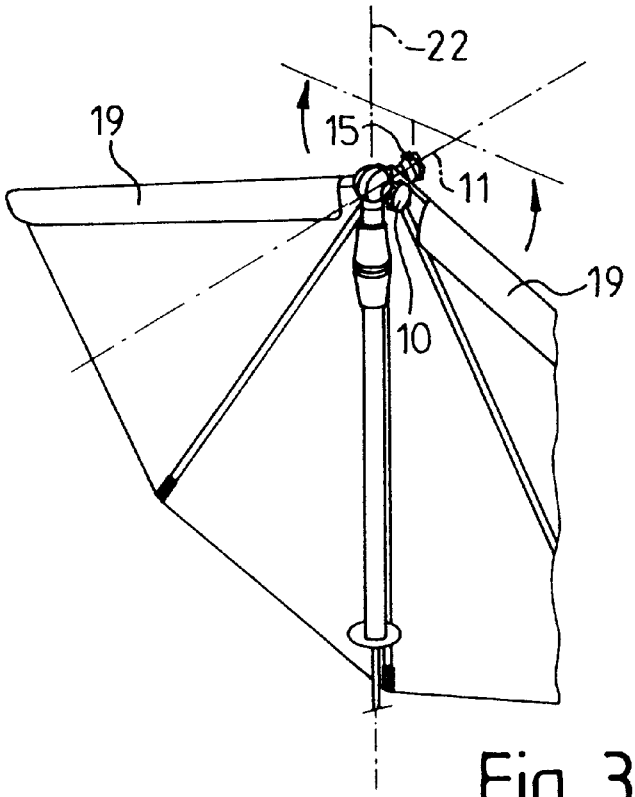
Figure 3B:
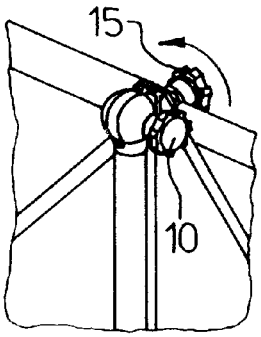
Figure 3C:
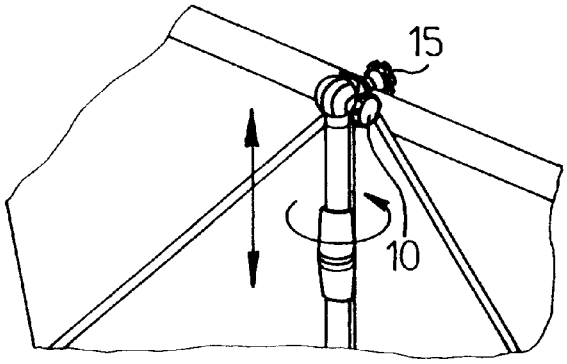
Figure 4:
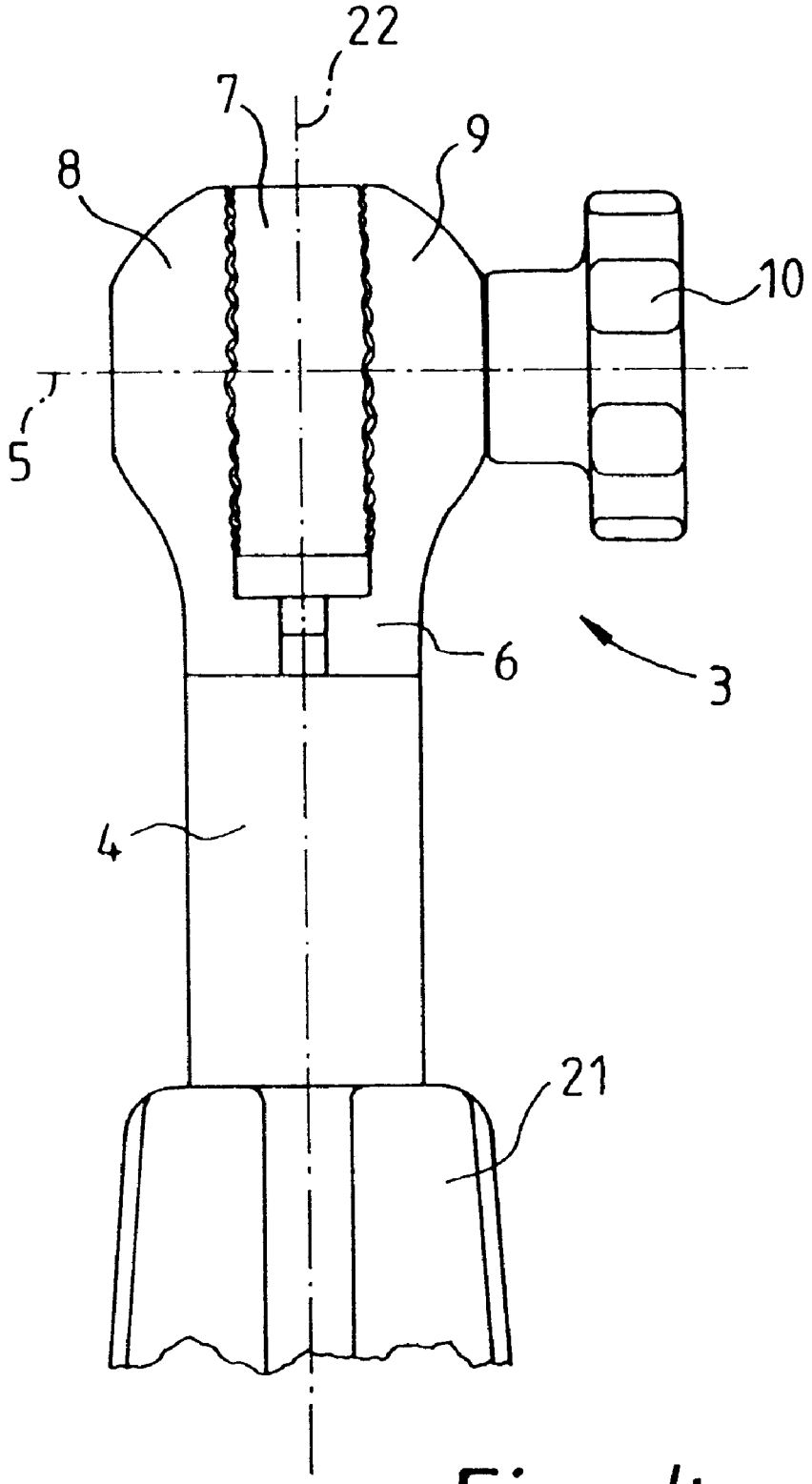

An exemplary embodiment of the invention is illustrated in the drawings and is explained even more precisely with details of further advantages and features. In the drawings FIG. 1 shows, in a perspective view, a sun protection device having a foldable fan-type sunshade in the opened-up state, FIG. 2 shows, in a perspective view, an enlargement of the sun protection device according to FIG. 1 in the region of a pivot joint, FIGS. 3*a–c* show, in a perspective view, folding states of the sun protection device illustrating the construction of the sun protection device, and FIG. 4 shows a side view of the pivot joint.

The sun protection device 1 consists of a fanlike sunshade 2 which is coupled to a sunshade pole 4 via a pivot joint 3.

The pivot joint 3 is arranged at the end of the sunshade pole 4 and consists of two joint pieces 6, 7 which can pivot together about a pivot axis 5. Those parts of the joint pieces which mesh together form a type of ball and slide with respect to each other on circular ring-shaped joint surfaces, which are arranged symmetrically to a plane that includes the longitudinal axis 22 of the sunshade pole. The joint piece 6, which is fastened to the end 4 of the sunshade pole, has two limbs 8, 9, with the result that a holding fork is produced.

Between the limbs the joint piece 7 is arranged in a manner which allows it to rotate about the circular ring-shaped joint surfaces. The pairs of joint surfaces preferably have a toothed surface, as shown in FIG. 4, so that the pivot joint 3 can be locked in any position with little expenditure of force via a clamping screw 10. On the joint piece 7 sunshade rods, 12, 13, 14 are arranged in a manner which allows them to pivot about a pivot axis 11, which lies in a plane with the longitudinal axis 22 of the sunshade pole (see FIG. 3*a*). The middle sunshade rod 12 is preferably fixed in its position on the joint piece 7, for example by being mounted in a longitudinal groove. The pivot axis 11 is provided, for example, in the form of a clamping screw 15. When the clamping screw 15 is released, the sunshade rods 13, 14 can be collapsed or spread apart. A sunshade covering 16 is fixed on the sunshade rods 12 to 14, for example via plug-in shoes 17 which are provided at the outer edge of the sunshade covering 16 for the ends of the sunshade rods 12 to 14.

So that the sunshade covering 16 does not slip out of the plug-in shoes 17, it is additionally fixed on the clamping screw 15. This can be done, for example, via a ring which fits loosely on the axis of the clamping screw 15 but cannot be pulled over the head of the said screw.

So that the edge region of the sunshade covering is fixed particularly well on the outer sunshade rods 14, the sunshade covering does not only have a plug-in shoe 17 for each of the sunshade rods 14, but also has an insertion pocket 19 extending over at least part of the sunshade rod 14.

The sunshade covering 16 moreover in each case has a strip-shaped extension 18 which extends beyond the outer sunshade rod 14.

Touch-and-close fastenings 20 are fastened on the strip-shaped extension 18 of the sunshade covering 16, so that a type of pocket can be formed around the sunshade pole 4 by the sunshade covering in the folded in state of the sunshade 2.

The construction of the sun protection device 1 is shown in FIGS. 3*a* to 3*c*. The sunshade 2 is first of all fanned out with the clamping screw 15 released and then the clamping screw 15 is tightened. After that, the sunshade 2 is raised over the pivot joint 3 with the clamping screw 10 released and fixed in the desired position by the clamping screw being tightened.

The height of the sunshade can be adjusted by the sunshade pole 4, which is of telescopic configuration, via adjusting means 21.

LIST OF REFERENCE NUMBERS

1 Sun protection device
2 Sunshade
3 Pivot joint
4 Sunshade pole
5 Pivot axis
6 Joint piece
7 Joint piece
8 Limb
9 Limb
10 Clamping screw
11 Pivot axis
12 Sunshade rod
13 Sunshade rod
14 Sunshade rod
15 Clamping screw
16 Sunshade covering
17 Plug-in shoe
18 Strip-shaped region
19 Insertion pocket
20 Touch-and-close fastening
21 Adjusting means

What is claimed is:

1. Sun protection device having a fanlike sunshade which includes rods which are mounted at one end in a manner which allows them to pivot about a common first axis for individual adjustment, so that the rods can be collapsed or spread apart by pivoting about this first axis, and which has a sunshade covering which is mounted between the rods, and the device also having a sunshade pole on which the rods are arranged via a pivot joint which has a pivot axis extending transversely to the longitudinal axis of the sunshade pole, characterized in that the pivot joint (3) is designed in such a manner that in every position of the joint the first pivot axis (11) lies in a plane with the longitudinal axis of the sunshade pole (4).

2. Sun protection device according to claim 1, characterized in that the pivot joint. (3) is designed as an extension of the sunshade pole (4).

3. Sun protection device according to claim 1 or 2, characterized in that the pivot joint has at least two pairs of joint surfaces which are arranged symmetrically to a plane in which the longitudinal axis of the sunshade pole (4) lies.

4. Sun protection device according to claim 1, characterized in that the pivot joint (3) is of spherical design.

5. Sun protection device according to claim 3, characterized in that the pairs of joint surfaces have latching means.

6. Sun protection device according to claim 1 or 2, characterized in that one joint piece (6) of the pivot joint (3) is of forked design.

7. Sun protection device according to claim 1 or 2, characterized in that the pivot joint (3) is designed in such a manner that the first pivot axis (11) is approximately aligned with the axis of the sunshade pole (4) if the rods (12, 14), as viewed from the side, are at a right angle to the sunshade pole (4).

8. Sun protection device according to claim 1 or 2, characterized in that the first axis (11) is provided by a clamping screw (15) and in that the sunshade covering is fixed on the clamping screw (15).

9. Sun protection device according to claim 1 or 2, characterized in that the sunshade covering (16) extends beyond the rods (14) and fastening means (20) are provided in this region (18) of the sunshade covering (16).

* * * * *